US011414921B2

(12) United States Patent
Kikuchi et al.

(10) Patent No.: US 11,414,921 B2
(45) Date of Patent: Aug. 16, 2022

(54) STORAGE DEVICE

(71) Applicant: Panasonic Intellectual Property Management Co., Ltd., Osaka (JP)

(72) Inventors: Takeshi Kikuchi, Osaka (JP); Yoshinari Matsuyama, Osaka (JP); Masaki Shikanai, Kanagawa (JP); Yuzuka Isobe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 167 days.

(21) Appl. No.: 16/864,394

(22) Filed: May 1, 2020

(65) Prior Publication Data

US 2020/0256117 A1 Aug. 13, 2020

Related U.S. Application Data

(63) Continuation of application No. PCT/JP2018/041252, filed on Nov. 6, 2018.

(30) Foreign Application Priority Data

Nov. 10, 2017 (JP) ..... JP2017-217688

(51) Int. Cl.
*A47B 49/00* (2006.01)
*E06B 3/90* (2006.01)
*E05D 15/02* (2006.01)

(52) U.S. Cl.
CPC ..... *E06B 3/903* (2013.01); *A47B 49/00* (2013.01); *E05D 15/02* (2013.01); *E05Y 2900/20* (2013.01)

(58) Field of Classification Search
CPC ..... A47B 49/00; A47B 88/433; A47B 53/00; E05D 15/02; E06B 3/903; E06B 3/70; B23Q 2210/006

(Continued)

(56) References Cited

U.S. PATENT DOCUMENTS

2020/0227928 A1* 7/2020 Matsumoto ..... H01M 10/441

FOREIGN PATENT DOCUMENTS

| | | |
|---|---|---|
| CH | 312116 | 2/1956 |
| JP | 50-051120 | 4/1976 |

(Continued)

OTHER PUBLICATIONS

International Search Report dated Feb. 5, 2019 in International (PCT) Application No. PCT/JP2018/041252 with English translation.

*Primary Examiner* — Daniel J Troy
*Assistant Examiner* — Daniel Alvarez
(74) *Attorney, Agent, or Firm* — Wenderoth, Lind & Ponack, L.L.P.

(57) ABSTRACT

A storage device includes a shutter having a vertically divided dome shape formed by cutting a one-end-closed cylindrical shape at two planes, the one-end-closed cylindrical shape being formed by closing an upper end of a cylindrical portion whose axis line is along an up-down direction, an arc-shaped lower portion reinforcing member which has a higher rigidity than the cylindrical portion, a housing, which includes an opening portion, the opening portion being opened and closed by the shutter rotating around the axis line, a bearing portion provided in the housing, which suspends and supports the ceiling surface portion, a lower end support portion, which supports a lower surface of the lower portion reinforcing member at a plurality of locations; and an inner side support portion, which supports an inner peripheral surface of the lower portion reinforcing member at a plurality of locations.

5 Claims, 11 Drawing Sheets

(58) Field of Classification Search
USPC ..... 49/41
See application file for complete search history.

(56) References Cited

FOREIGN PATENT DOCUMENTS

| | | |
|---|---|---|
| JP | 2004-316289 | 11/2004 |
| JP | 3156751 | 1/2010 |

* cited by examiner

STORAGE DEVICE

CROSS REFERENCE TO RELATED APPLICATION(S)

This application is a continuation of International Patent Application No. PCT/JP2018/041252 filed on Nov. 6, 2018, which claims the benefit of priority of Japanese Patent Application No. 2017-217688 filed on Nov. 10, 2017, the contents of which are incorporated herein by reference in its entirety.

BACKGROUND OF THE INVENTION

1. Field of the Invention

The present disclosure relates to a storage device which stores an object to be stored.

2. Description of the Related Art

JP-A-2004-316289 referred to as Patent Literature 1 discloses an indoor crime prevention shutter which is attached to an indoor side of an opening portion of a building. In such an indoor crime prevention shutter, a shutter box is provided at an indoor side upper portion of the opening portion of the building. The shutter box accommodates a slat winding portion which performs a slat winding or unwinding operation. A guide mechanism, which guides slats wound or unwound from the slat winding portion, is provided on two sides of the opening portion. The indoor crime prevention shutter opens and closes the planar opening portion by lifting and lowering the slats guided to the two sides by the guide mechanism. The guide mechanism supports a load acting on the slats in one direction of inner direction or outer direction of the opening portion.

Patent Literature 1: JP-A-2004-316289

SUMMARY OF THE INVENTION

In a shutter device in related art, stored objects cannot be covered with a shutter while supporting loads from a plurality of directions.

The present disclosure has been devised in view of the above-described situation in the related art, and a non-limited object thereof is to provide a storage device which supports loads from a plurality of directions, even when an external force is applied, to exactly protect an object to be stored in a storage space covered by a shutter.

The storage device according to the present disclosure includes: a shutter having a vertically divided dome shape formed by cutting a one-end-closed cylindrical shape at two planes, the one-end-closed cylindrical shape being formed by closing an upper end of a cylindrical portion whose axis line is along an up-down direction by a ceiling surface portion, the two planes intersecting each other on the axis line or in a vicinity of the axis line; an arc-shaped lower portion reinforcing member, which has a higher rigidity than the cylindrical portion and is integrally fixed to a lower end surface of the cylindrical portion; a housing, which includes an opening portion, the opening portion being opened and closed by the shutter rotating around the axis line which serves as a rotation center; a bearing portion provided in the housing, which suspends and supports the ceiling surface portion in a manner that enables the ceiling surface portion to freely rotate around the axis line; a lower end support portion, which is provided in the housing and supports a lower surface of the lower portion reinforcing member at a plurality of locations along the lower surface; and an inner side support portion, which is provided in the housing and supports an inner peripheral surface of the lower portion reinforcing member at a plurality of locations along the inner peripheral surface.

According to the present disclosure, the object to be stored in the storage space covered by the shutter can be exactly protected by supporting the loads from the plurality of directions even when the external force is applied.

DETAILED DESCRIPTION OF THE EXEMPLARY EMBODIMENTS (Background of Present Disclosure)

As an example of a storage device in related art, in the indoor crime prevention shutter of Patent Literature 1 described above, since the opening portion is opened and closed by the planar shutter, the stored object cannot be taken in and out from a plurality of directions. On the other hand, when an external force is applied to a ceiling surface of the shutter in a case where the opening portion is covered with a polyhedron-shaped rotatable shutter, stress concentrates on a rotating portion, and the shutter is excessively deformed (for example, deformed to an extent where the use thereof as a shutter is interfered), so that usability of the invention may be poor.

Therefore, in the following embodiment, an example of a storage device, which is capable of exactly protecting an object to be stored in a storage space covered by a shutter by supporting loads from a plurality of directions even when an external force is applied, will be described.

Hereinafter, the embodiment (hereinafter, referred to as "the present embodiment") that specifically discloses the storage device according to the present disclosure will be described in detail with reference to the drawings as appropriate. Unnecessarily detailed descriptions may be omitted. For example, a detailed description of a well-known matter or a repeated description of substantially the same configuration may be omitted. This is to prevent the following description from being unnecessarily redundant and to facilitate understanding of those skilled in the art. The accompanying drawings and the following description are provided for those skilled in the art to facilitate thorough understanding of the present disclosure, and are not intended to limit the claimed subject matters.

Figure 1:
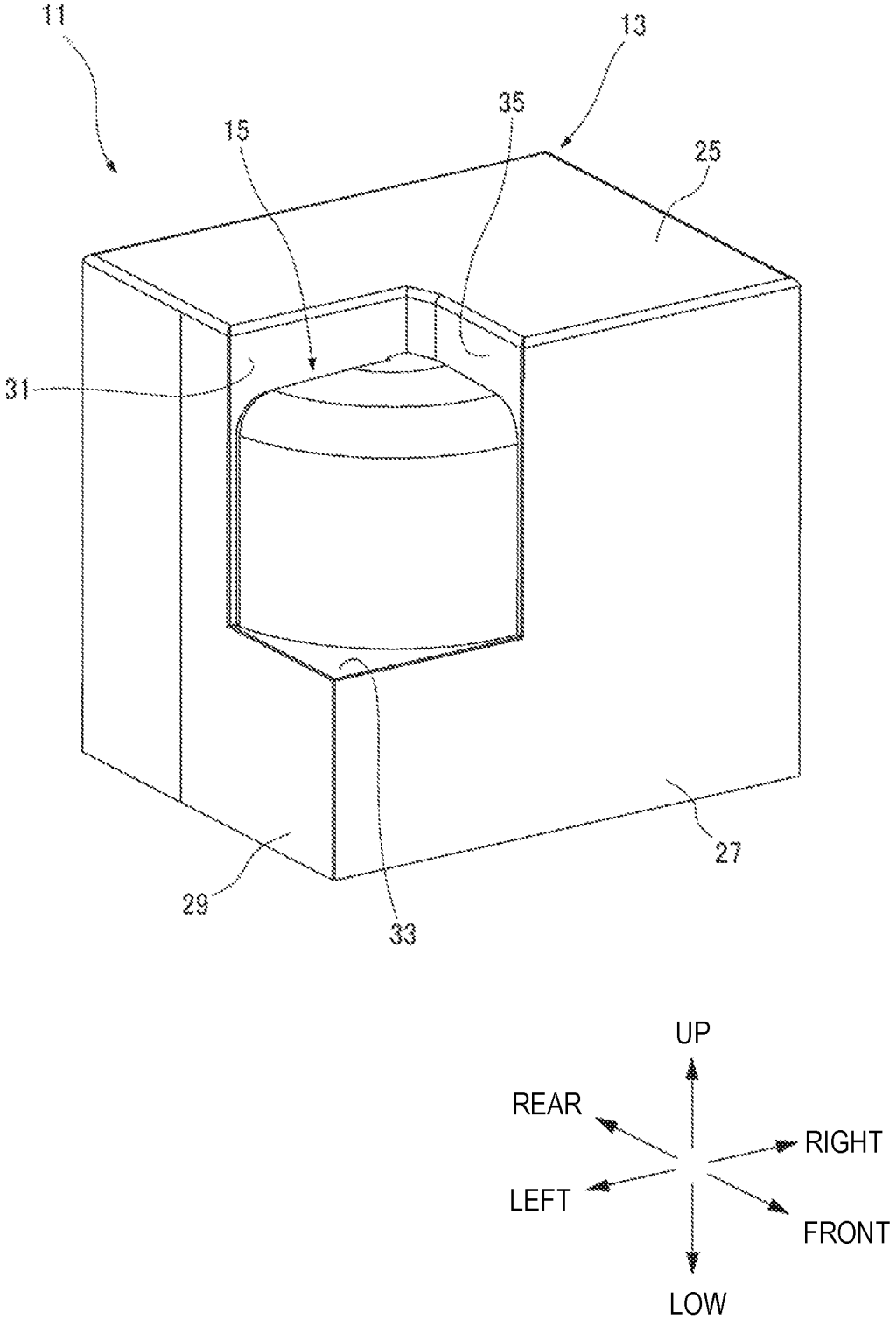
FIG. 1 is a perspective view of a storage device according to the present embodiment.

FIG. 1 is a perspective view of a storage device 11 according to the present embodiment. In the present embodiment, upper and lower, front and rear, left and right directions follow directions of arrows shown in FIG. 1.

The storage device 11 according to the present embodiment includes a housing 13, a shutter 15, a lower portion reinforcing member 17, a bearing portion 19 (see FIG. 3), a lower end support portion 21 (see FIG. 3), and an inner side support portion 23 (see FIG. 5) as main components.

The housing 13 has, for example, a hexahedral outer shape. In the present embodiment, the housing 13 is formed of a substantially rectangular parallelepiped or a rectangular parallelepiped which is thin in a front-rear direction and high in an up-down direction. One corner portion of the housing 13, which is sandwiched between an upper surface 25, a front surface 27, and a side surface 29, is removed by a back surface 31 parallel to the front surface 27, a bottom surface 33 parallel to the upper surface 25, and an inner side surface 35 parallel to the side surface 29. The housing 13 includes an opening portion 37 at an inner corner portion where the corner portion is removed. The opening portion 37 can be opened and closed by the shutter 15.

Figure 2:
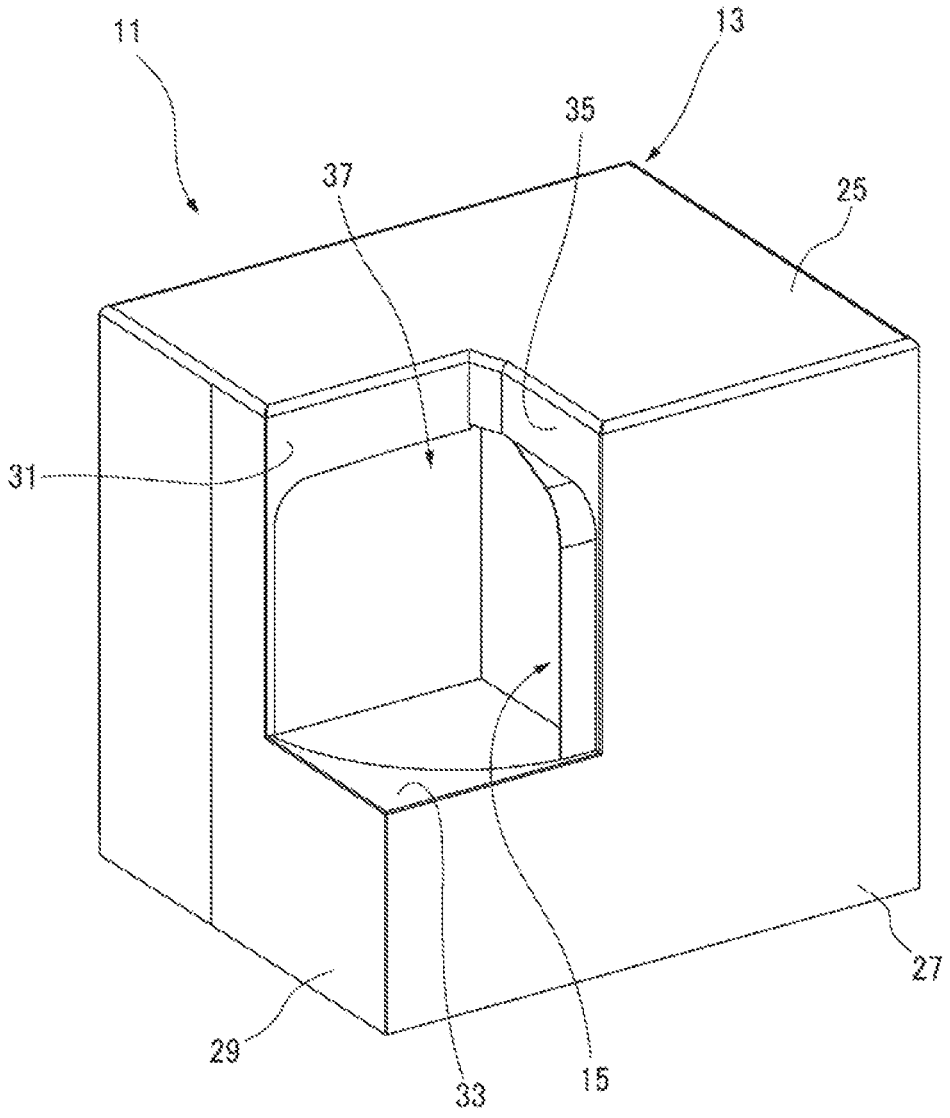
FIG. 2 is a perspective view of a state where a shutter of the storage device shown in FIG. 1 is opened.

FIG. 2 is a perspective view of a state where the shutter 15 of the storage device 11 shown in FIG. 1 is opened. An axis line 39 (see FIG. 3) of the shutter 15 is in the up-down direction. The shutter 15 rotates about the axis line 39 which serves as a rotation center. The housing 13 is opened and closed by the shutter 15 rotating about the axis line 39 which serves as the rotation center. A rotation angle of the shutter 15 is set to approximately 90°. When the opening portion 37 is opened as shown in FIG. 2, almost the whole shutter 15 is accommodated in the housing 13.

The rotation angle of the shutter 15 is not limited to approximately 90°. The rotation angle of the shutter 15 can be set to any angle as long as the rotation angle is substantially equal to or less than 180°. When the rotation angle is approximately 180°, the shutter 15 can be formed into a half-split dome shape. However, the shutter 15 may have a dome shape whose circumferential length is longer than that of the half-split shape as long as exposure of an unaccommodated portion is acceptable.

Figure 3:
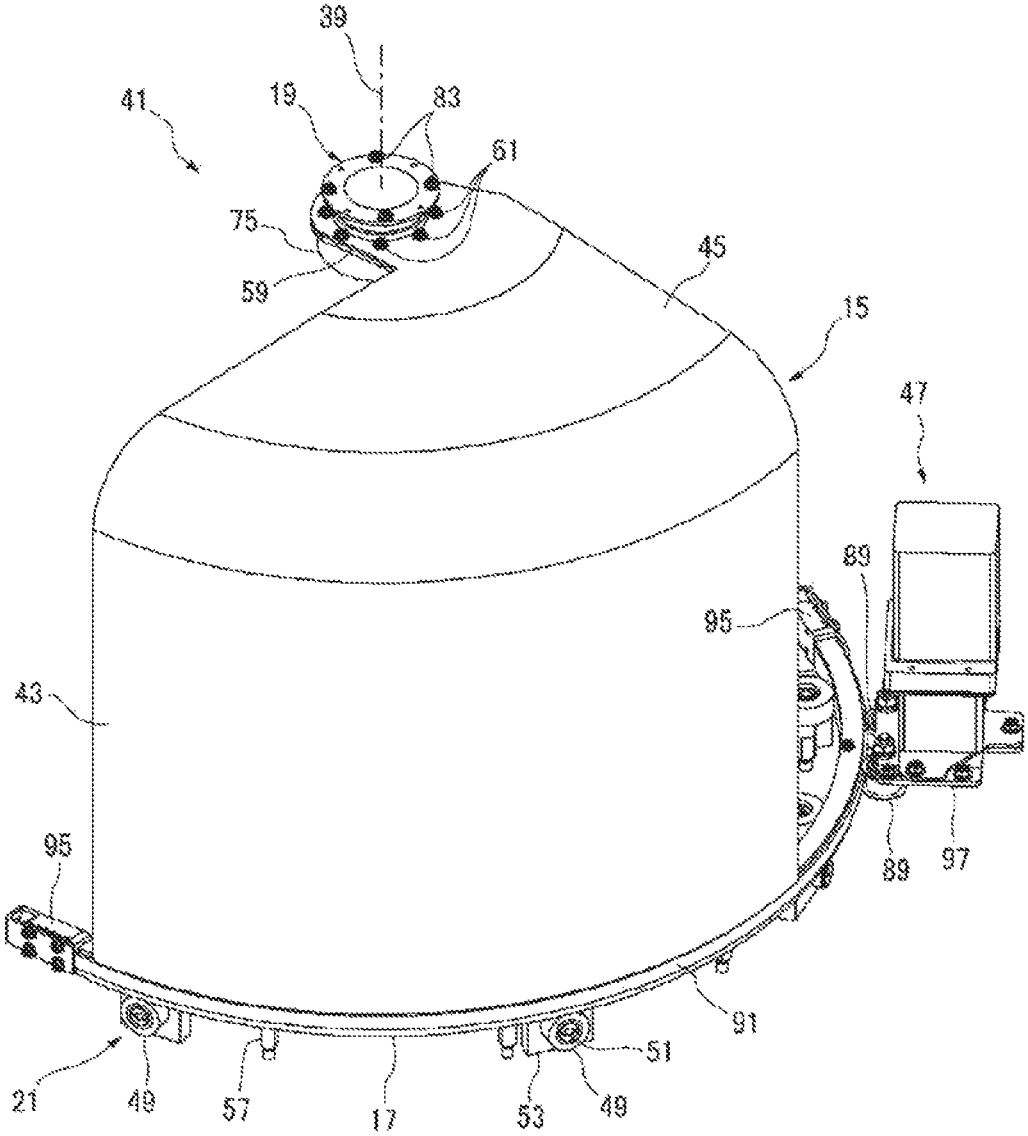
FIG. 3 is a perspective view of a shutter opening and closing mechanism viewed obliquely from above.

FIG. 3 is a perspective view of a shutter opening and closing mechanism 41 viewed obliquely from above. The shutter 15 in the present embodiment has a vertically divided dome shape. The shutter 15 includes a cylindrical portion 43 whose axis line 39 is in the up-down direction. The cylindrical portion 43 has a one-end-closed cylindrical shape (also referred to as a bottomed cylindrical shape) whose upper end is closed by a ceiling surface portion 45. The vertically divided dome shape is a shape in which the one-end-closed cylindrical shape is cut at two planes intersecting each other on the axis line or in the vicinity of the axis line of the cylindrical portion 43. In the present embodiment, the two planes are orthogonal to each other. Accordingly, the ceiling surface portion 45 has a fan shape obtained by substantially dividing a circle into four equal parts. Similarly, a cylinder of the cylindrical portion 43 is also divided into four equal parts to obtain vertically divided curved plate shapes.

The cylindrical portion 43 is divided in a circumferential direction thereof so as to have a circumferential length as that of the fan-shaped ceiling surface portion 45, and is coupled to the ceiling surface portion 45. Although normal lines of the ceiling surface portion 45 and the cylindrical portion 43 are orthogonal to each other in the present embodiment, the present invention is not limited thereto. The shutter 15 may have, for example, a vertically divided dome shape in which a hemispherical ceiling surface portion is connected to the cylindrical portion 43.

For example, polypropylene (PP), a hard resin material, or the like may be used as a material of the shutter 15 in addition to carbon steel (soft iron: SS400 or the like), carbon steel (hard steel: S55C or the like), stainless steel (SUS304) and aluminum (Al1050).

Figure 4:
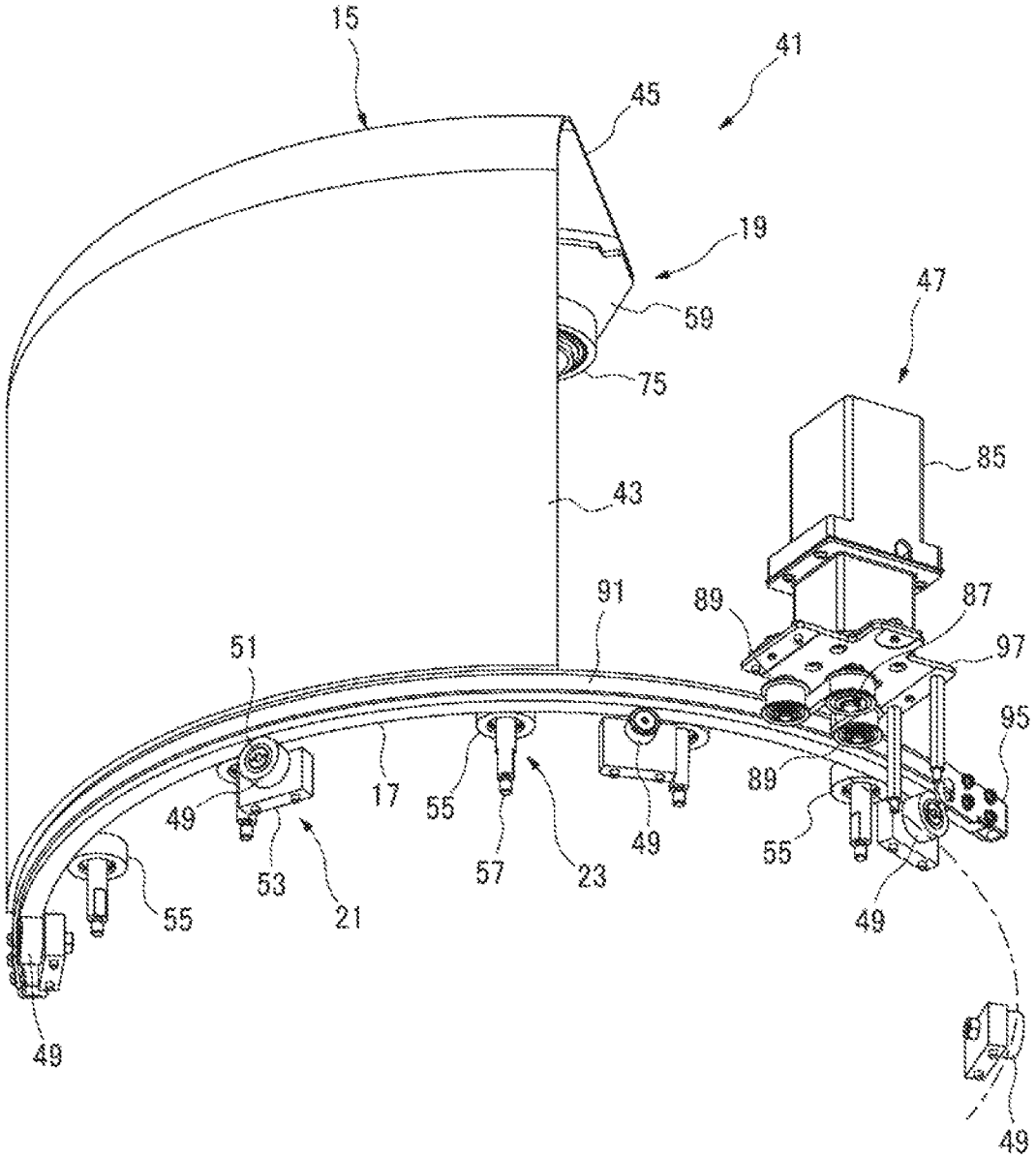
FIG. 4 is a perspective view of the shutter opening and closing mechanism of FIG. 3 viewed obliquely from below.

FIG. 4 is a perspective view of the shutter opening and closing mechanism 41 of FIG. 3 viewed obliquely from below. The lower portion reinforcing member 17 is integrally fixed to a lower end surface of the cylindrical portion 43 of the shutter 15. The lower portion reinforcing member 17 is longer than a circumferential length of the lower end surface of the cylindrical portion 43. A portion of the lower portion reinforcing member 17 extending from the lower end surface of the cylindrical portion 43 serves as an extended portion. The extended portion extends along a movement path of the shutter 15. When the shutter 15 closes the opening portion 37 (see FIG. 1), the extended portion has an extra length for connecting the shutter 15 to a shutter driving mechanism 47 to be described below, which is provided inside the housing 13. The lower portion reinforcing member 17 has a higher rigidity than that of the cylindrical portion 43. Reference strength of the shutter 15 is improved by fixing the lower portion reinforcing member 17 to the lower end surface of the cylindrical portion 43.

The lower end support portion 21 is provided in the housing 13 of the storage device 11. The lower end support portion 21 supports a lower surface of the lower portion reinforcing member 17. The lower end support portion 21 is provided at a plurality of locations (for example, five locations in the present embodiment) along the lower surface of the lower portion reinforcing member 17. It should be noted that the number of the lower end support portions 21 is not limited to five.

In the present embodiment, the lower end support portion 21 is, for example, a lower portion roller 49. The lower portion roller 49 is rotatably supported by a horizontal support shaft 51 orthogonal to the axis line 39. The horizontal support shaft 51 is fixed to a support member 53. The support member 53 is fixed to the housing 13.

Figure 5:
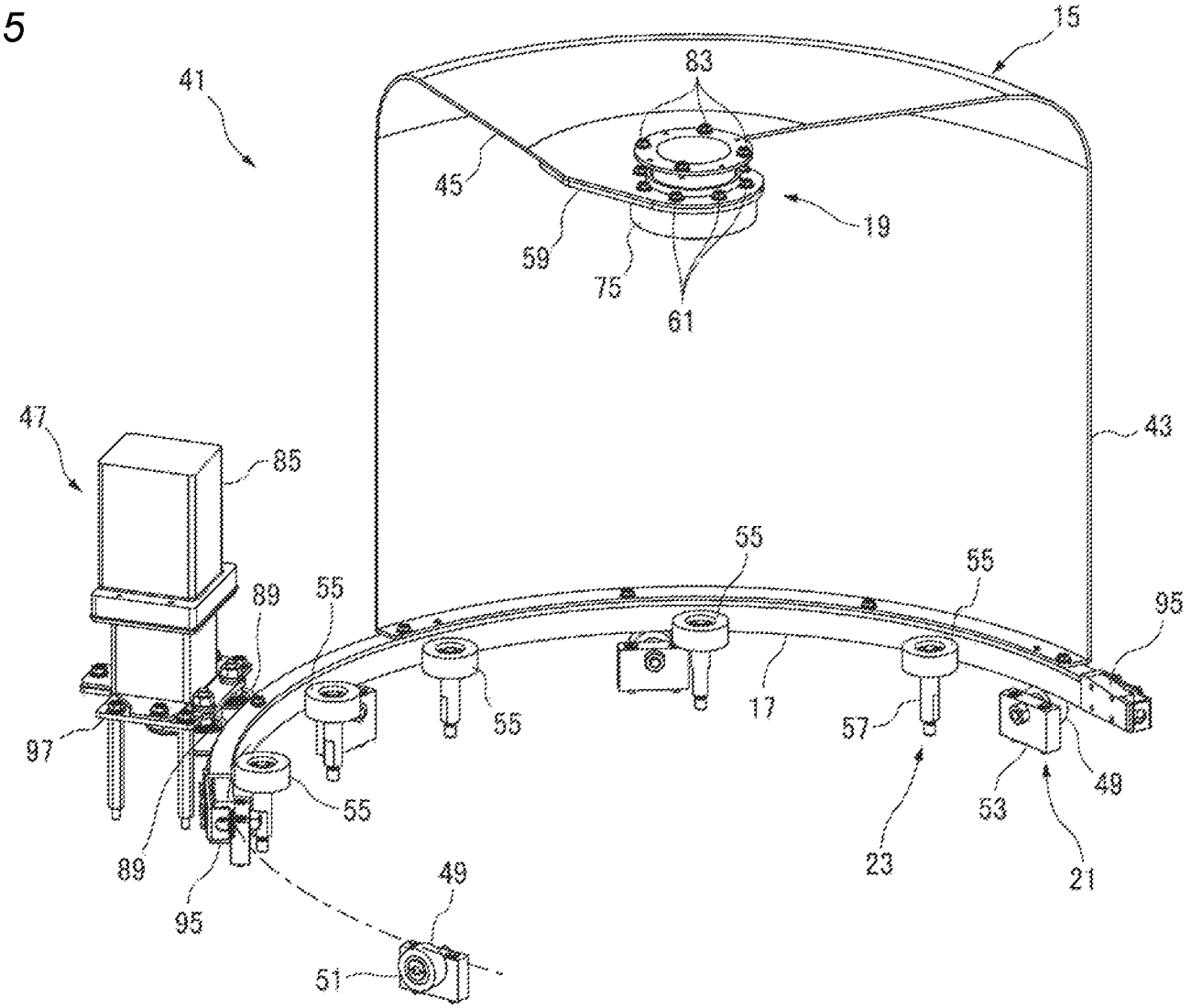
FIG. 5 is a perspective view of the shutter opening and closing mechanism of FIG. 3 viewed from a back surface side.

FIG. 5 is a perspective view of the shutter opening and closing mechanism 41 of FIG. 3 viewed from a back surface side. The inner side support portion 23 is provided in the housing 13 of the storage device 11. The inner side support portion 23 supports an inner peripheral surface of the lower portion reinforcing member 17. The inner side support portion 23 is provided at a plurality of locations (for example, five locations in the present embodiment) along the inner peripheral surface of the lower portion reinforcing member 17. It should be noted that the number of the inner side support portions 23 is not limited to five.

In the present embodiment, the inner side support portion 23 is, for example, an inner side roller 55. The inner side roller 55 is rotatably supported by a vertical support shaft 57 in the same direction as the axis line 39. An opposite end of the vertical support shaft 57, which rotatably supports the inner side roller 55, is fixed to the housing 13.

Although a configuration in which the lower end support portion 21 and the inner side support portion 23 are the lower portion roller 49 and the inner side roller 55 is described in the present embodiment, the lower end support portion 21 and the inner side support portion 23 are not limited thereto. For example, the lower end support portion 21 and the inner side support portion 23 do not have to include rotating bodies, such as rollers, as long as the lower end support portion 21 and the inner side support portion 23 lower portion reinforcing member 17 can contact and support the lower portion reinforcing member 17 with low friction.

Although a configuration in which the lower portion roller 49 and the inner side roller 55 are supported in the housing 13 is described in the present embodiment, the lower portion roller 49 and the inner side roller 55 can also be provided on the lower portion reinforcing member 17. In this case, the lower portion roller 49 and the inner side roller 55 provided on the lower portion reinforcing member 17 are supported by a rail member fixed to the housing 13.

Figure 6:
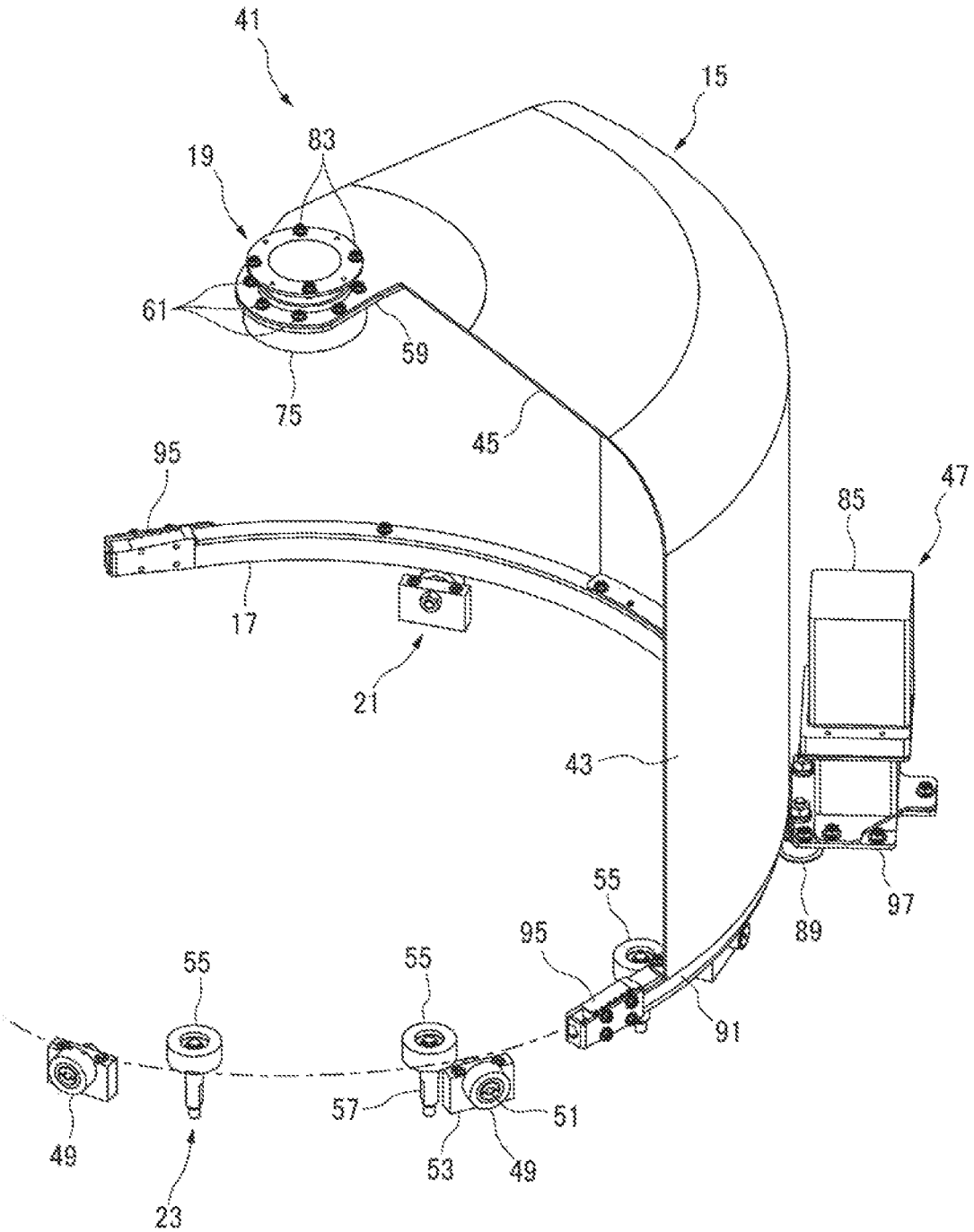
FIG. 6 is a perspective view of the shutter opening and closing mechanism of FIG. 3 in which the shutter is moved in an opening direction.

FIG. 6 is a perspective view of the shutter opening and closing mechanism 41 of FIG. 3 in which the shutter 15 is moved in an opening direction. The storage device 11 includes the bearing portion 19 which rotatably suspends and supports the shutter 15. The bearing portion 19 is provided in the housing 13, and rotatably supports the ceiling surface portion 45 of the shutter 15 around the axis line 39. The lower surface of the lower portion reinforcing member 17 is supported by the lower portion roller 49 in the storage device 11. Even when the lower portion roller 49 is not supported, the shutter 15 of the storage device 11 can be supported in a suspended state only by an upper portion of the bearing portion 19.

Figure 7:
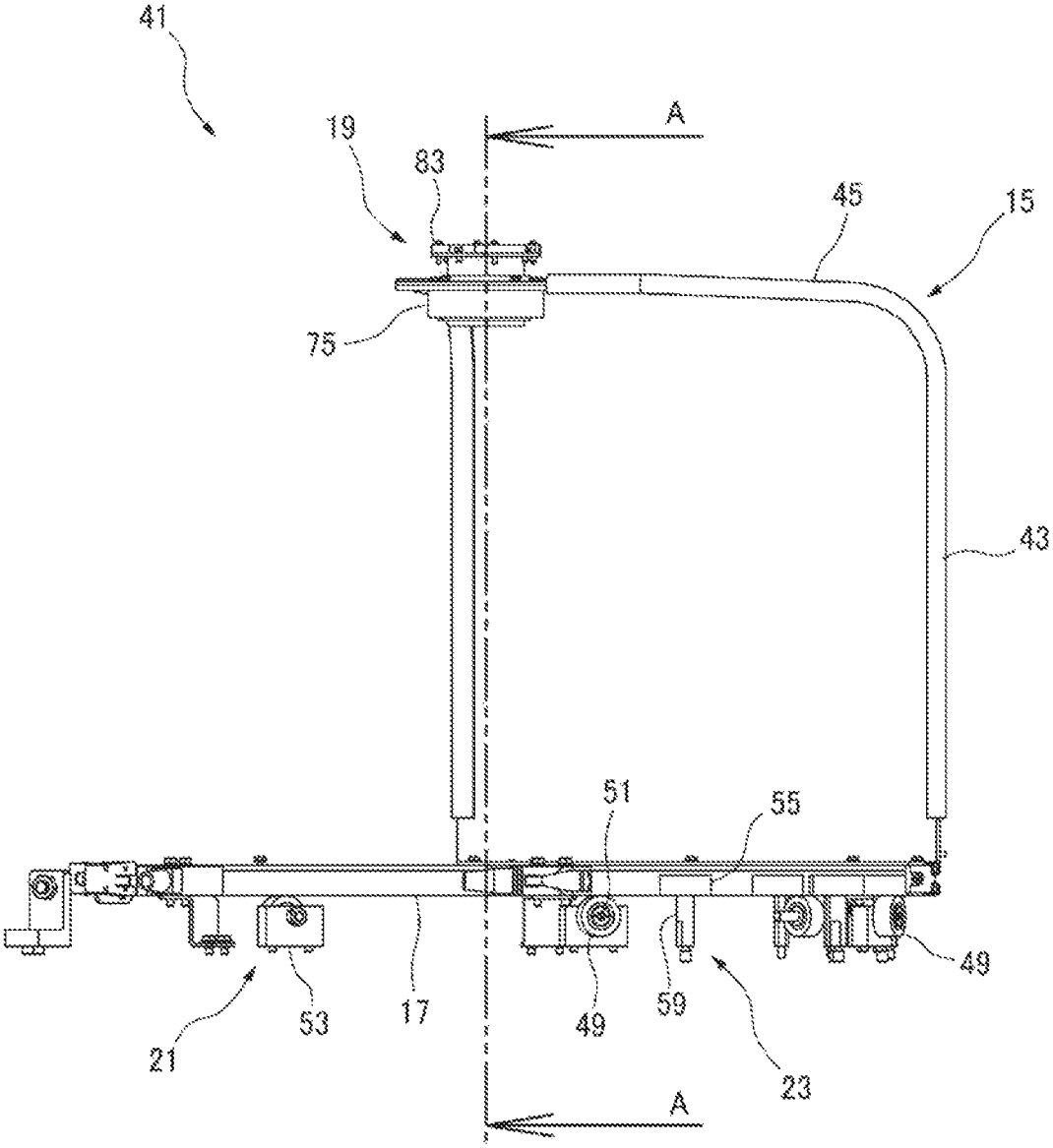
FIG. 7 is a side view of the shutter opening and closing mechanism viewed from an opening end side of the shutter.

FIG. 7 is a side view of the shutter opening and closing mechanism 41 viewed from an opening end side of the shutter 15. As described above, the ceiling surface portion 45 of the shutter 15 has a fan shape obtained by substantially dividing a circle into four equal parts, and the cylinder of the cylindrical portion 43 is also divided into four equal parts to obtain the vertically divided curved plate shapes. The bearing portion 19 is connected to a rotation center portion of the fan shape on a radial direction inner side (a side opposite to an arc side). Considering a case where the lower portion roller 49 is not supported, the shutter 15 is supported by the rotation center portion so as to form a cantilever shape. Even in a configuration in which the lower portion reinforcing member 17 is actually supported by the lower portion roller 49 as in the present embodiment, when a load is applied from the ceiling surface portion 45, stress is likely to concentrate at the rotation center portion.

Figure 8:
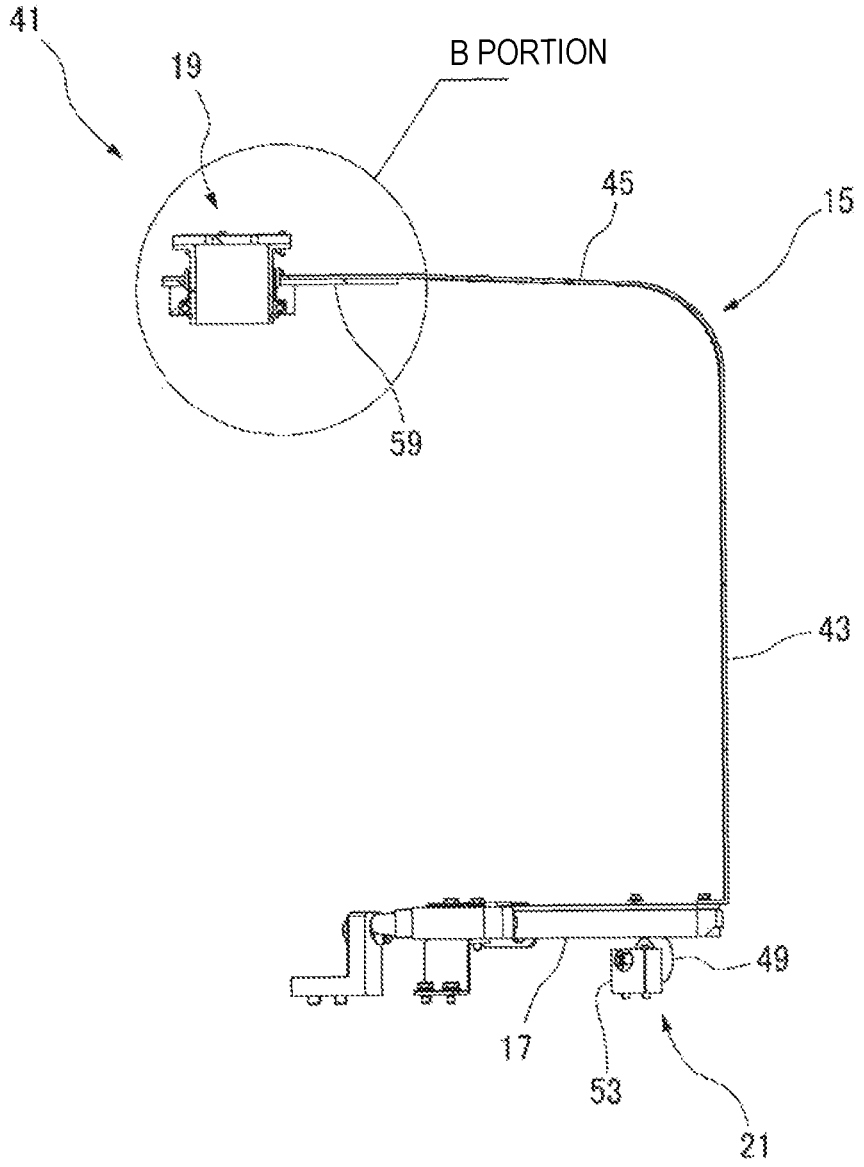
FIG. 8 is a cross-sectional view taken along A-A of FIG. 7.

FIG. 8 is a cross-sectional view taken along A-A of FIG. 7. The cross-sectional line A-A in FIG. 7 coincides with the axis line 39 of the cylindrical portion 43. In the storage device 11, strength of the shutter 15 is improved by reinforcing the rotation center portion of the ceiling surface portion 45. That is, the bearing portion 19 includes an upper portion reinforcing member 59.

Figure 9:
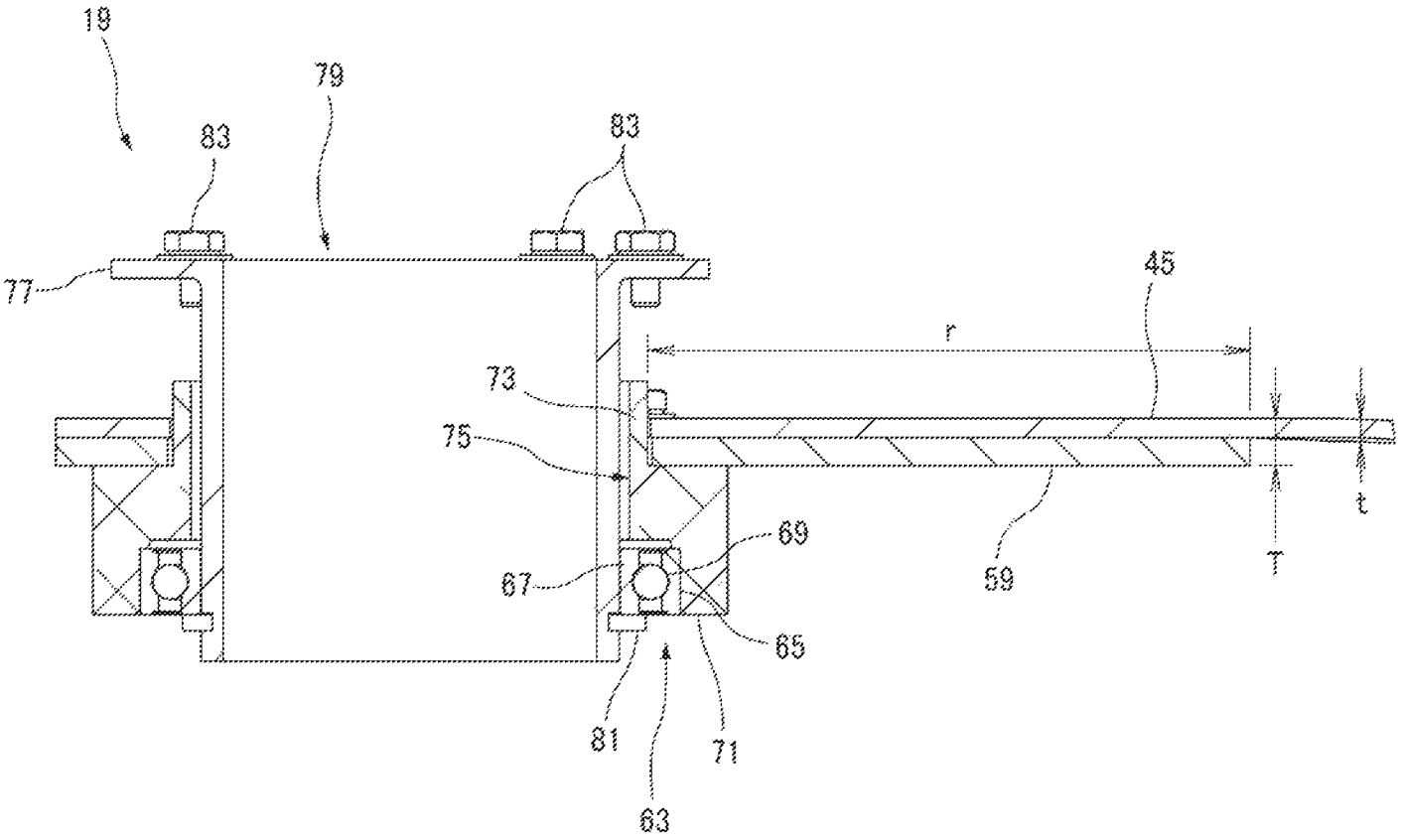
FIG. 9 is an enlarged view of B portion of FIG. 8.

FIG. 9 is an enlarged view of B portion of FIG. 8. The upper portion reinforcing member 59 extends radially outward about the axis line 39 and is formed in a fan shape. The upper portion reinforcing member 59 has a shape similar to that of the ceiling surface portion 45 and is fixed to the rotation center portion of the ceiling surface portion 45. The upper portion reinforcing member 59 is provided on a lower surface side of the rotation center portion and supports the ceiling surface portion 45. The rotation center portion of the ceiling surface portion 45 and the upper portion reinforcing member 59 are fixed by a plurality of through bolts 61 (see FIG. 6).

The bearing portion 19 includes a rolling bearing 63. The rolling bearing 63 includes an outer ring 65 and an inner ring 67. The rolling bearing 63 includes a plurality of rolling elements 69 which are rotatably provided between an outer ring raceway in the outer ring 65 and an inner ring raceway in the inner ring 67.

A bearing side upper portion reinforcing member 75, which includes a large diameter portion 71 and a small diameter portion 73, is fixed to an outer periphery of the outer ring 65. An outer periphery of the small diameter portion 73 of the bearing side upper portion reinforcing member 75 is fixed to the upper portion reinforcing member 59. An inner periphery of the large diameter portion 71 of the bearing side upper portion reinforcing member 75 is fixed to the outer periphery of the outer ring 65.

Meanwhile, an inner periphery of the inner ring 67 of the rolling bearing 63 is fixed to an outer periphery of a cylindrical sleeve 79 which includes a flange portion 77. Downward movement of the inner ring 67 is restricted by a retaining ring 81 attached to the outer periphery of the sleeve 79. The flange portion 77 of the sleeve 79 is fixed to the housing 13 by a fixing bolt 83, so that the bearing portion 19 is supported in a state of being suspended from the housing 13. Accordingly, the rolling bearing 63, whose inner ring 67 is fixed to a housing side, rotatably supports the rotation center portion of the ceiling surface portion 45 by the outer ring 65 via the bearing side upper portion reinforcing member 75 and the upper portion reinforcing member 59.

Although a radial bearing is exemplified as the rolling bearing 63 in FIG. 9, the rolling bearing 63 may also be a thrust bearing or an angular bearing. By using the thrust bearing or the angular bearing as the rolling bearing 63, the rolling bearing 63 can receive a higher axial direction load than in the case where the radial bearing is used. The rolling bearing 63 may also be an oilless bush.

The same material, such as soft iron (SS400), can be used for the shutter 15 and the upper portion reinforcing member 59. Tensile strength of the soft iron is 450 $N/mm^2$. When the same material is used for the shutter 15 and the upper portion reinforcing member 59, a plate thickness T of the upper portion reinforcing member 59 is formed to be larger than a plate thickness t of the shutter 15 especially in a small radius region r of the rotation center portion where stress concentration is likely to occur.

Figure 11:
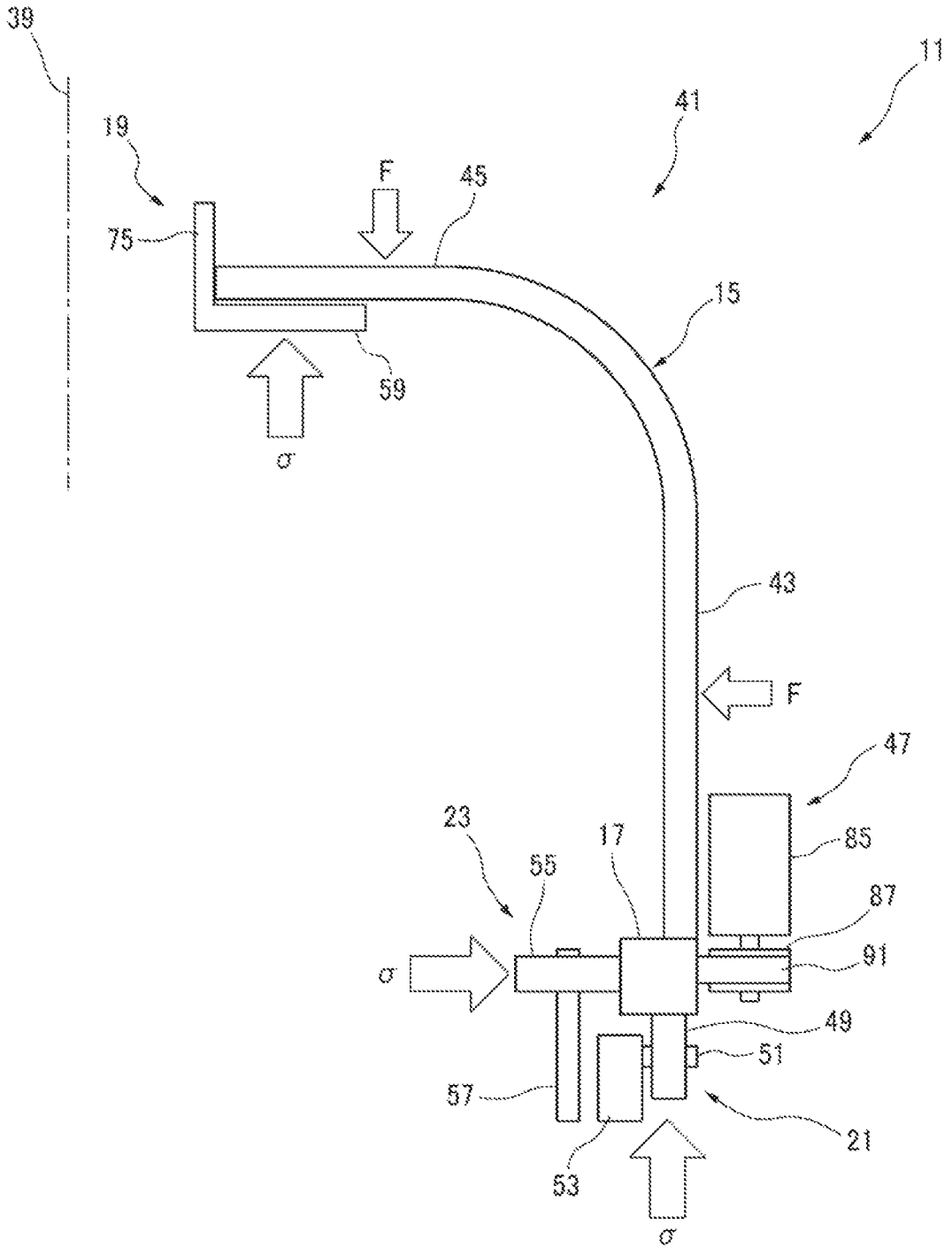
FIG. 11 is a schematic view conceptually showing the shutter driving mechanism placed in the storage device 11 according to the present embodiment.

The bearing portion 19, the lower end support portion 21, and the inner side support portion 23 of the storage device 11 are set to have a larger allowable stress $\sigma$ (see FIG. 11) than a load F that plastically deforms the shutter 15 from above (see FIG. 11) or a load F that plastically deforms the shutter 15 from a radial direction outer side (see FIG. 11). Here, the allowable stress refers to a maximum value of stress that can be withstood by corresponding portions (for example, the bearing portion 19, the lower end support portion 21, and the inner side support portion 23) such that use of the storage device 11 as a product can be guaranteed under an applied load (for example, rotation of the shutter 15 is restrained), and the same applies hereinafter. In other words, even when the load F described above is applied to each of or one of the bearing portion 19, the lower end support portion 21, and the inner side support portion 23 of the storage device 11, the shutter 15 is deformed first, so that deformation of the bearing portion 19 and the like of the storage device 11 is restrained, and the shutter 15 is avoided from being broken or damaged to such an extent that the rotation thereof is disabled. As a result, even if the shape of the shutter 15 is slightly changed by the load F, an outer shape (in other words, an outer frame) of the shutter 15 does not change greatly in the storage device 11, so that an object to be stored (for example, a package body) inside the storage device 11 can be exactly protected.

Figure 10:
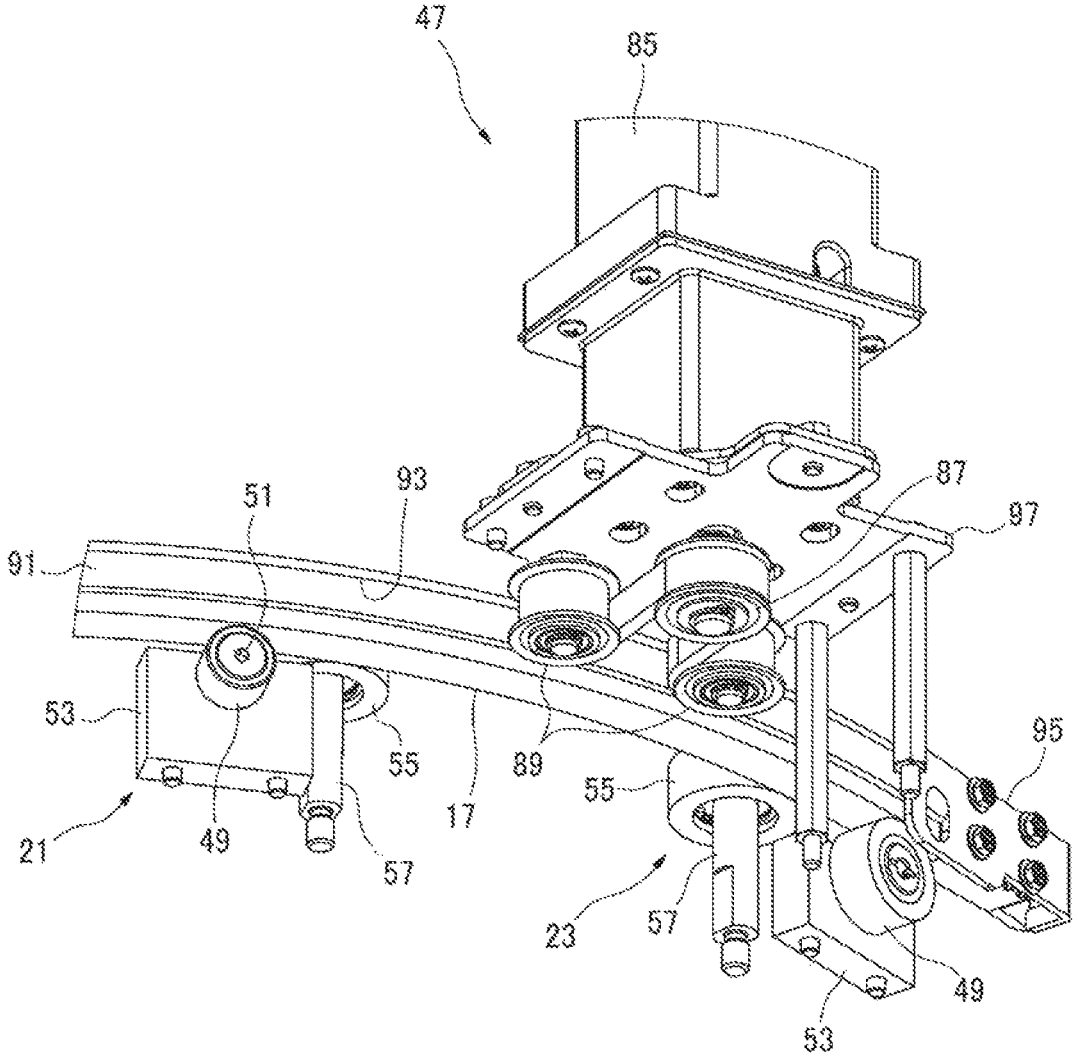
FIG. 10 is a main part perspective view showing an example of a shutter driving mechanism placed in a storage device 11 according to the present embodiment.

FIG. 10 is a main part perspective view showing an example of the shutter driving mechanism 47 placed in the storage device 11 according to the present embodiment. In the present embodiment, the shutter 15 is opened and closed by the shutter driving mechanism 47. The shutter driving mechanism 47 includes an electric motor 85, a timing pulley 87 fixed to a driving shaft of the electric motor 85, a pair of guide pulleys 89, and a timing belt 91.

A belt accommodation groove 93 is formed on an outer periphery of the lower portion reinforcing member 17. The timing belt 91 is accommodated in the belt accommodation groove 93. Two ends of the timing belt 91 accommodated in the belt accommodation groove 93 are fixed to two ends of the lower portion reinforcing member 17 by a belt holding member 95.

A bracket 97 is fixed to the electric motor 85 which is fixed to the housing 13. The pair of guide pulleys 89 are spaced apart from each other and rotatably supported by the bracket 97 along the belt accommodation groove 93. The driving shaft of the electric motor 85 penetrates between the pair of guide pulleys 89 on a side opposite to the belt accommodation groove 93 with respect to the guide pulley 89. The timing pulley 87 is fixed to the driving shaft. The timing belt 91 whose direction is changed by the pair of guide pulleys 89 is wound around an outer periphery of the timing pulley 87.

As a result, when the electric motor 85 is driven, the timing pulley 87 is rotated. When the timing pulley 87 rotates, the timing belt 91 which is wound thereon is sent in a rotation direction thereof. As a result, the shutter driving mechanism 47 rotates the shutter 15 forward and backward by the timing belt 91 whose two ends are fixed to the lower portion reinforcing member 17, so as to allow the opening portion 37 to open and close.

Although the shutter 15 is opened and closed by the electric motor 85 in the present embodiment, the shutter driving mechanism may also be a mechanism in which a handle or the like is attached to the shutter 15 and the shutter 15 is opened and closed manually.

Next, effects of the configuration of the storage device 11 according to the present embodiment will be described.

FIG. 11 is a schematic view conceptually showing the shutter driving mechanism 47 placed in the storage device 11 according to the present embodiment.

In the storage device 11 according to the present embodiment, the shutter 15 is a member having the vertically divided dome shape formed by cutting the one-end-closed cylindrical shape at two planes, the one-end-closed cylindrical shape being formed by closing the upper end of the cylindrical portion 43 whose axis line 39 is along the up-down direction by the ceiling surface portion 45, the two planes intersecting each other on the axis line or in the vicinity of the axis line. The lower portion reinforcing member 17 is the arc-shaped member which has a higher rigidity than the cylindrical portion 43 and is integrally fixed to the lower end surface of the cylindrical portion 43. The housing 13 includes the opening portion 37 which is opened and closed by the shutter 15 rotating around the axis line 39 serving as the rotation center. The bearing portion 19 is provided in the housing 13, suspends and supports the ceiling surface portion 45 in the manner that enables the ceiling surface portion 45 to freely rotate around the axis line 39. The lower end support portion 21 is provided in the housing 13 and supports the lower surface of the lower portion reinforcing member 17 at the plurality of locations along the lower surface. The inner side support portion 23 is provided in the housing 13 and supports the inner peripheral surface of the lower portion reinforcing member 17 at the plurality of locations along the inner peripheral surface.

Accordingly, in the storage device 11 according to the present embodiment, the vertically divided dome-shaped shutter 15 is attached to the opening portion 37 of the housing 13 so as to freely open and close the opening portion 37. The housing 13 includes a storage space on an inner side of the opening portion 37. The shutter 15 is supported by the housing 13 in the state where the ceiling surface portion 45 is suspended by the bearing portion 19. Moreover, the lower portion reinforcing member 17 is integrally fixed to the lower end surface of the cylindrical portion 43, so that the lower portion of the shutter 15 is reinforced to improve rigidity thereof. Further, since the lower surface of the lower portion reinforcing member 17 is supported by the lower end support portion 21, the lower portion reinforcing member 17 supports an external force acting on the shutter 15 from above. In addition, since the inner peripheral surface of the lower portion reinforcing member 17 is supported by the inner side support portion 23, the shutter 15 supports an external force acting on the radial direction inner side from outside.

As a result, in the storage device 11, the bearing portion 19, the lower portion reinforcing member 17, the lower end support portion 21, and the inner side support portion 23 support loads from a plurality of directions, thereby ensuring strength for restraining breakage of a shutter support structure. As a result, the storage device 11 can cover the convenient opening portion 37, which allows a stored object to be taken in and out from a plurality of directions, by the shutter 15 having the polyhedron shape, and can reliably protect the stored object covered by the shutter 15.

The shutter 15 of the storage device 11 can be made thinner as compared with a case where the load is received only by the upper portion of the bearing portion 19.

The lower end support portion 21 of the storage device 11 is the plurality of lower portion rollers 49 which are rotatably supported by the horizontal support shaft 51 orthogonal to the axis line 39. The inner side support portion 23 is the plurality of inner side rollers 55 which are rotatably supported by the vertical support shaft 57 in the same direction as the axis line 39.

Accordingly, in the storage device 11, since the lower end support portion 21 is the lower portion rollers 49, the lower surface of the lower portion reinforcing member 17 can be supported with low friction by the rotating lower portion rollers 49 during opening and closing operations. Similarly, since the inner side support portion 23 is the inner side rollers 55, the inner peripheral surface of the lower portion reinforcing member 17 can be supported with low friction by the rotating inner side rollers 55 during the opening and closing operations. As a result, the shutter 15 can ensure the strength for restraining the breakage of the shutter support structure and restrain an increase in a rotational driving force for opening and closing.

In the storage device 11, the bearing portion 19 is formed in the fan shape extending radially outward about the axis line 39, and includes the upper portion reinforcing member 59 which supports the ceiling surface portion 45.

Accordingly, the bearing portion 19 of the storage device 11 includes the upper portion reinforcing member 59. The upper portion reinforcing member 59 extends radially outward about the axis line 39 and is formed in the fan shape. The rotation center side of the upper portion reinforcing member 59 is fixed to the outer ring 65 of the bearing portion 19. That is, the upper portion reinforcing member 59 is rotatably supported by the housing 13 via the bearing portion 19. The upper portion reinforcing member 59 is integrally fixed to the rotation center portion of the ceiling surface portion 45 of the shutter 15. Accordingly, the external force applied to the ceiling surface portion 45 from above is transmitted from the bearing portion 19 to the housing 13 via the upper portion reinforcing member 59. As a result, the shutter 15 can secure strength for restraining breakage caused by stress concentration at the rotation center portion of the ceiling surface portion 45 connected to the bearing portion 19 with a small area.

Further, the bearing portion 19, the lower end support portion 21, and the inner side support portion 23 of the storage device 11 are set to have the larger allowable stress a than the load F that plastically deforms the shutter 15 from above or the load F that plastically deforms the shutter 15 from the radial direction outer side. In other words, even when the load F described above is applied to each of or one of the bearing portion 19, the lower end support portion 21, and the inner side support portion 23 of the storage device 11, the shutter 15 is deformed first, so that deformation of the bearing portion 19 and the like of the storage device 11 is restrained, and the shutter 15 is avoided from being broken or damaged to such an extent that the rotation thereof is disabled. As a result, even if the shape of the shutter 15 is slightly changed by the load F, the outer shape (in other words, the outer frame) of the shutter 15 does not change greatly in the storage device 11, so that the object to be stored (for example, the package body) inside the storage device 11 can be exactly protected.

Accordingly, in the storage device 11, the bearing portion 19, the lower end support portion 21, and the inner side support portion 23 serve as the shutter support structure. The allowable stress of the shutter support structure is set to be larger than the load F that plastically deforms the shutter 15. In other words, the load F that plastically deforms the shutter 15 is set to be smaller than the allowable stress a of the shutter support structure. It should be noted that the load F that plastically deforms the shutter 15 from above is a load F that is equal to or less than tensile strength (maximum stress) of a shutter material and equal to or more than an elastic limit.

Therefore, when the load F that plastically deforms the shutter 15 acts, the shutter 15 of the storage device 11 plastically deforms before the shutter support structure is broken. Accordingly, when the load F acts on the ceiling surface portion 45 or the cylindrical portion 43, the storage device 11 can restrain the shutter support structure from being broken and restrain the shutter from colliding with the stored object directly. In other words, the storage device 11 can absorb impact or the like by plastically deforming the shutter 15, so as to protect the stored object.

Therefore, according to the storage device 11 according to the present embodiment, the loads from the plurality of directions can be supported, so that the stored object stored in the storage space covered by the shutter 15 can be protected.

Although the embodiment has been described above with reference to the drawings, it is needless to say that the present disclosure is not limited to such examples. It will be apparent to those skilled in the art that various changes and modifications can be conceived within the scope of the claims, and it should be understood that such changes and modifications also belong to the technical scope of the present disclosure. Constituent elements in the above-described embodiment may be optionally combined within a range not departing from the spirit of the invention.

In the present embodiment described above, the shutter 15, the upper portion reinforcing member 59, and the lower portion reinforcing member 17 may be integrally formed. In this case, by appropriately changing thicknesses of the shutter 15, the upper portion reinforcing member 59, and the lower portion reinforcing member 17, strength (for example, rigidity) of the shutter 15, the upper portion reinforcing member 59, and the lower portion reinforcing member 17 can be changed.

The present disclosure is useful as a storage device which can exactly protect an object to be stored in a storage space covered by a shutter by supporting loads from a plurality of directions even when an external force is applied.

Reference signs used in the specification and drawings are listed as below.

11: Storage device
13: Housing
15: Shutter
17: Lower portion reinforcing member
19: Bearing portion
21: Lower end support portion
23: Inner side support portion
37: Opening portion
39: Axis line
43: Cylindrical portion
45: Ceiling surface portion
49: Lower portion roller
51: Horizontal support shaft
55: Inner side roller
57: Vertical support shaft
59: Upper portion reinforcing member

What is claimed is:

1. A storage device comprising:

a shutter having dome shape formed by cutting a one-end-closed cylindrical shape at two planes;

an arc-shaped lower portion reinforcing member, which has a higher rigidity than the shutter and is integrally fixed to a lower end surface of the shutter;

a housing, which includes an opening portion, the opening portion being opened and closed by rotation of the shutter about an axis line;

a bearing portion provided in the housing, which suspends and supports the shutter;

a lower end support portion, which is provided in the housing and supports a lower surface of the lower portion reinforcing member along the lower surface;

an inner side support portion, which is provided in the housing and supports an inner peripheral surface of the lower portion reinforcing member along the inner peripheral surface; and a motor provided in the housing, which opens and closes the shutter through the lower portion reinforcing member.

2. The storage device according to claim 1, wherein the lower end support portion is a plurality of lower portion rollers which are rotatably supported at a plurality of locations on a horizontal support shaft orthogonal to the axis line, and the inner side support portion is a plurality of inner side rollers which are rotatably supported at a plurality of locations on a vertical support shaft in a same direction as the axis line.

3. The storage device according to claim 1, wherein the bearing portion is a fan shape extending radially outward about the axis line, and the bearing portion includes an upper portion reinforcing member which supports a ceiling surface portion of the shutter.

4. The storage device according to claim 1, wherein the bearing portion, the lower end support portion, and the inner side support portion have a larger allowable stress than a stress applied by a load that plastically deforms the shutter from above or a stress applied by a load that plastically deforms the shutter from an outer side in a radial direction.

5. The storage device according to claim 1, wherein a width of the lower portion reinforcing member is longer than a width of the shutter.

* * * * *